United States Patent [19]

Terzian

[11] 4,057,928

[45] Nov. 15, 1977

[54] ARTICULATED DOLL

[75] Inventor: Rouben T. Terzian, Chicago, Ill.

[73] Assignee: Marvin Glass & Associates, Chicago, Ill.

[21] Appl. No.: 655,621

[22] Filed: Feb. 5, 1976

[51] Int. Cl.[2] ..... A63H 13/00

[52] U.S. Cl. ..... 46/120; 46/118; 46/126; 46/135 A

[58] Field of Search ..... 46/116, 118, 119, 120, 46/154, 126, 141, 135 R, 135 A

[56] References Cited

U.S. PATENT DOCUMENTS

| | | | |
|---|---|---|---|
| 427,927 | 5/1890 | Steiner | 46/141 |
| 1,651,738 | 12/1927 | Stein et al. | 46/154 X |
| 2,196,912 | 4/1940 | Gilbraith | 46/135 A |
| 2,655,762 | 10/1953 | Burke | 46/116 |
| 2,698,499 | 1/1955 | Dygon | 46/126 X |
| 3,757,463 | 9/1973 | Breslow et al. | 46/120 X |
| 3,882,631 | 5/1975 | Goldfarb et al. | 46/44 |

OTHER PUBLICATIONS

"Vinylite", Advertisement from Women's Home Companion of Mar. 1952.

*Primary Examiner*—F. Barry Shay
*Attorney, Agent, or Firm*—Mason, Kolehmainen, Rathburn & Wyss

[57] ABSTRACT

An articulated doll with a movable head capable of motioning "yes" and "no" in response to an external mechanical stimulus. The head is horizontally pivotally mounted upon a vertical shaft for effecting a downwardly pivoting "yes" motion, and the shaft is rotatable about its longitudinal axis for effecting a "no" movement of the head. The movements of the head are caused by manually compressing a pair of independent external squeeze bulbs hidden within a blanket for the doll. The bulbs are in communication with a pair of bellows mounted within the body of the doll. Expansion of the bellows acts through pivoting arms to move the head, as described. A third squeeze bulb, hidden within the blanket, is connected to a hidden external reservoir and pumps water through tubes to tear ducts in each eye of the doll.

5 Claims, 8 Drawing Figures

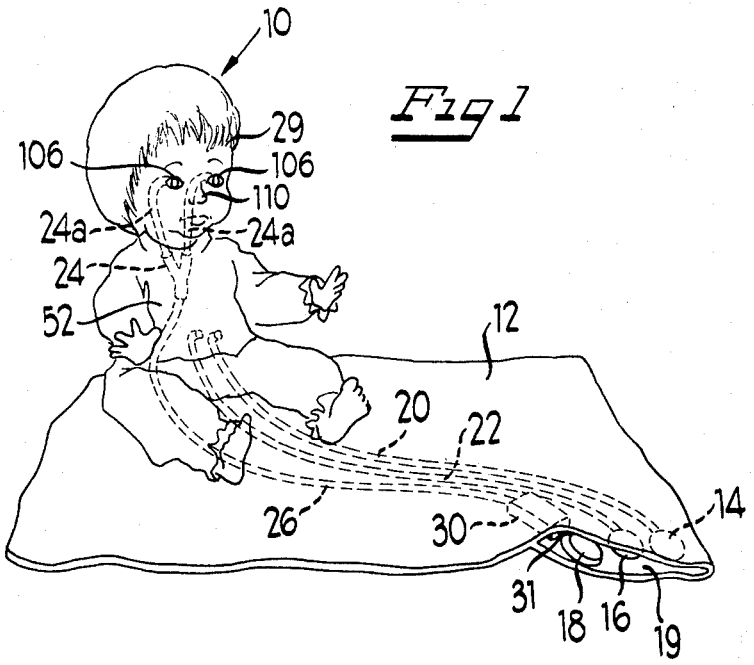
Fig 1
Fig 4
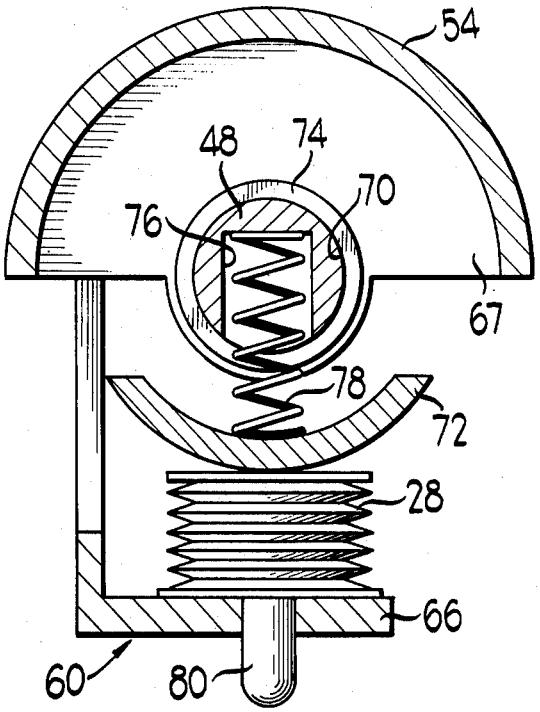
Fig 5
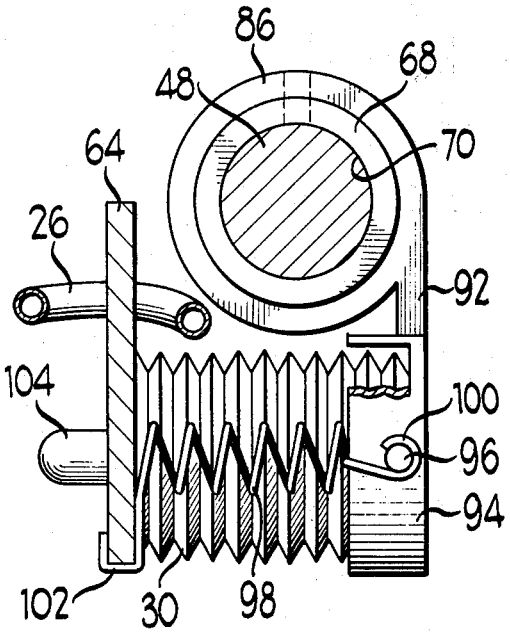

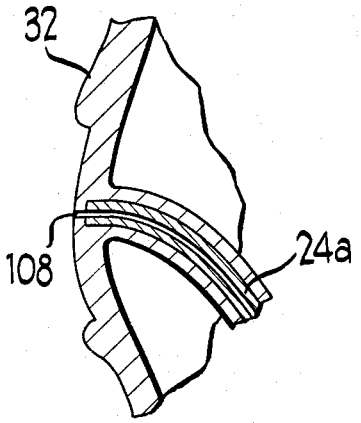
Fig 6
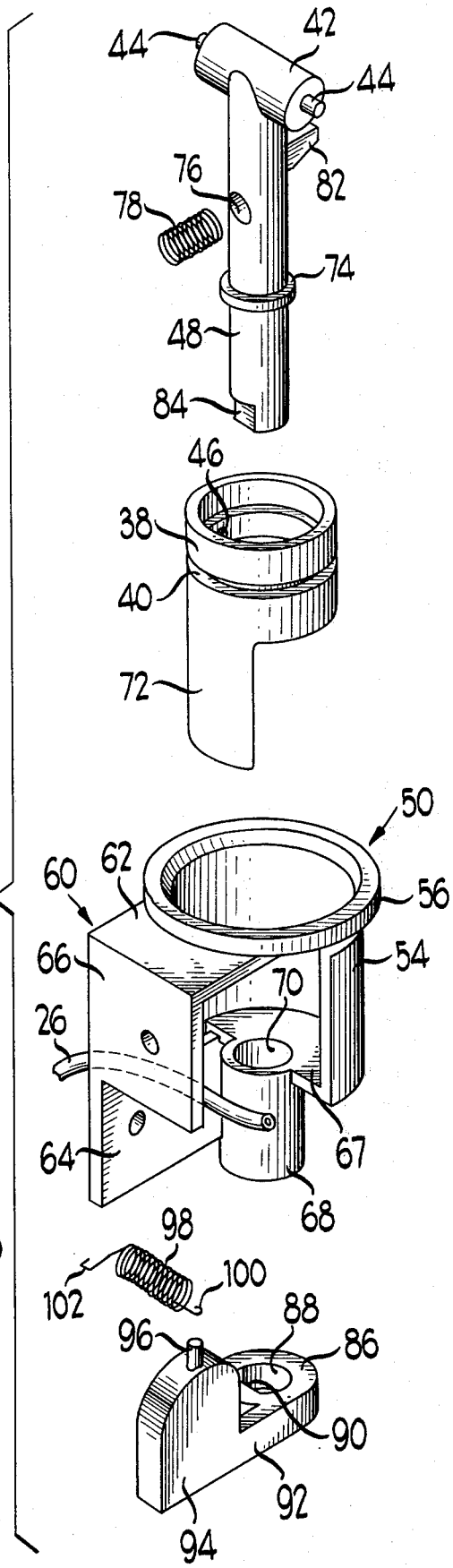
Fig 7
Fig 8
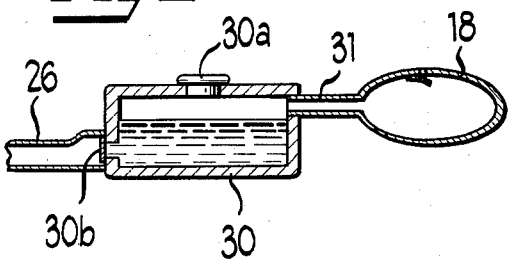

ARTICULATED DOLL

SUMMARY OF THE INVENTION

This invention relates to articulated dolls and, more particularly, a doll with a head capable of turning to emulate a "yes" and "no" motion. The doll's head is pivotally mounted on a horizontal transverse shaft which, in turn, is pivotally mounted on a vertical shaft in the neck area of the doll. A pair of bellows act through lever arms to pivot the head about the horizontal shaft or the vertical shaft about its own axis to accomplish the desired movements. The bellows movement is accomplished by external squeeze bulbs hidden in a blanket and coupled to the bellows by tubes. When the external bulbs are squeezed, the increased pressure expands the bellows to move pivot arms connected thereto. A third squeeze bulb acts through a reservoir which is coupled by tubes to tear duct apertures in the eyes of the doll to simulate tearing.

BRIEF DESCRIPTION OF THE DRAWINGS

FIG. 1 is a perspective view of the doll of this invention seated upon a blanket with external squeeze bulbs therewithin;

FIG. 4 is a section taken generally along line 4—4 of FIG. 3;

FIG. 5 is a section taken generally along line 5—5 of FIG. 3; FIG. 6 is a fragmented sectional view showing the termination of a tear duct;

FIG. 7 is an exploded perspective view of the "yes" and "no" motion pivoting mechanism, without the bellows; and FIG. 8 is a vertical section through the means for supplying liquid to the eye tear ducts.

DESCRIPTION OF THE PREFERRED EMBODIMENT

Figure 2:
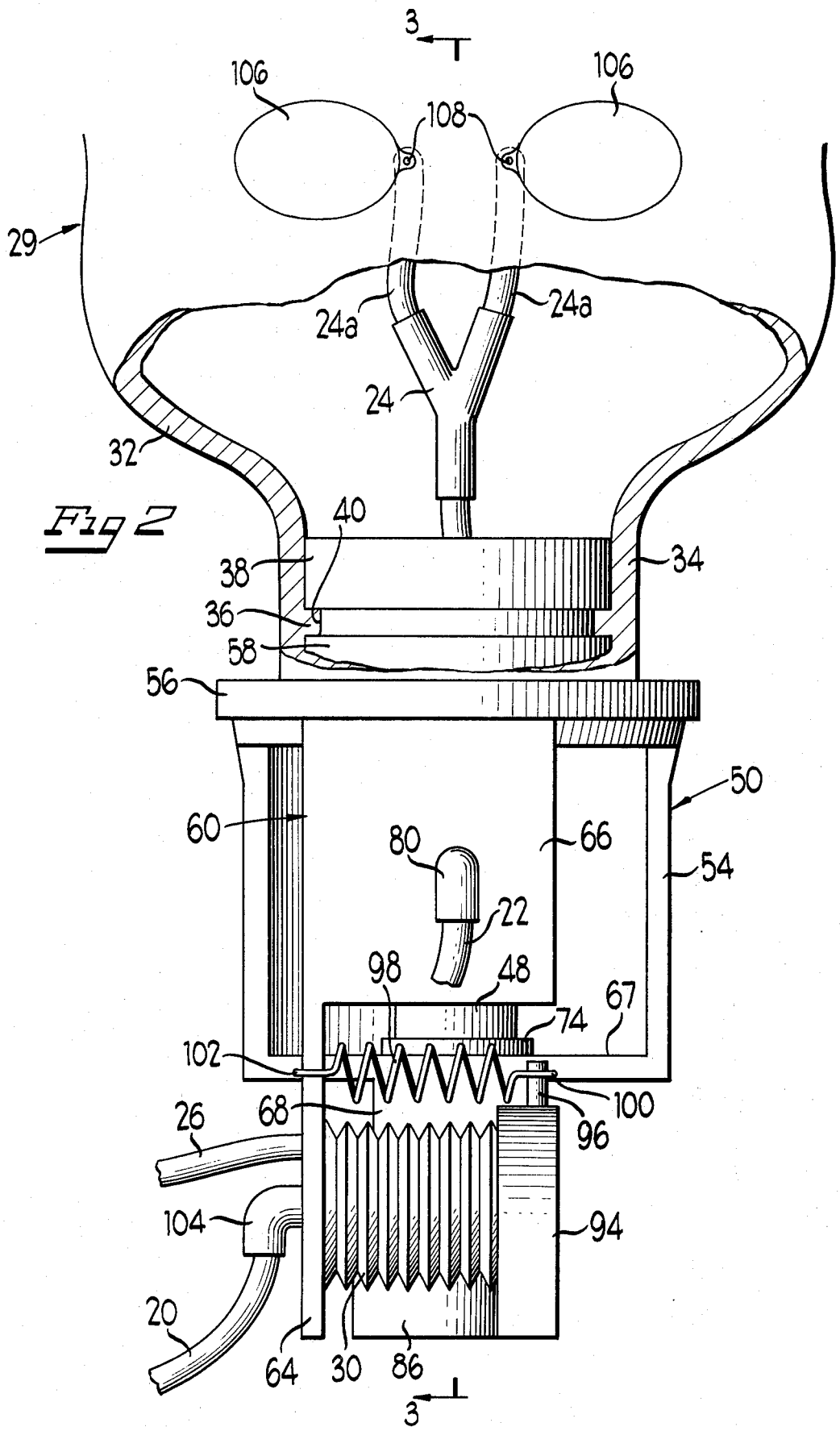
FIG. 2 is a fragmented cut-away view, on an enlarged scale, of the head moving mechanism within the neck and body of the doll, with the doll body removed, and additionally shows the eyes and tear ducts with the tubes leading thereto.

The preferred embodiment of the present invention in the form of an animated doll is generally designated 10 and is seated upon a blanket 12. The doll 10 includes internal mechanisms for vertically reciprocating the doll's head signifying a response of "yes" and for rotatably reciprocating the doll's head indicating a response of "no", as well as tear means for both of the doll's eyes.

The head movement and the tears are activated upon the squeezing of a plurality of squeeze bulbs 14, 16 and 18, located within a pocket 19 within the blanket 12, one bulb controlling each function. The bulbs are connected to the doll through a plurality of connecting tubes 20, 22 and 26. The connecting tubes are flexible conducting tubes within the blanket 12 and enter the body of the doll 10 through the back thereof.

Figure 3:
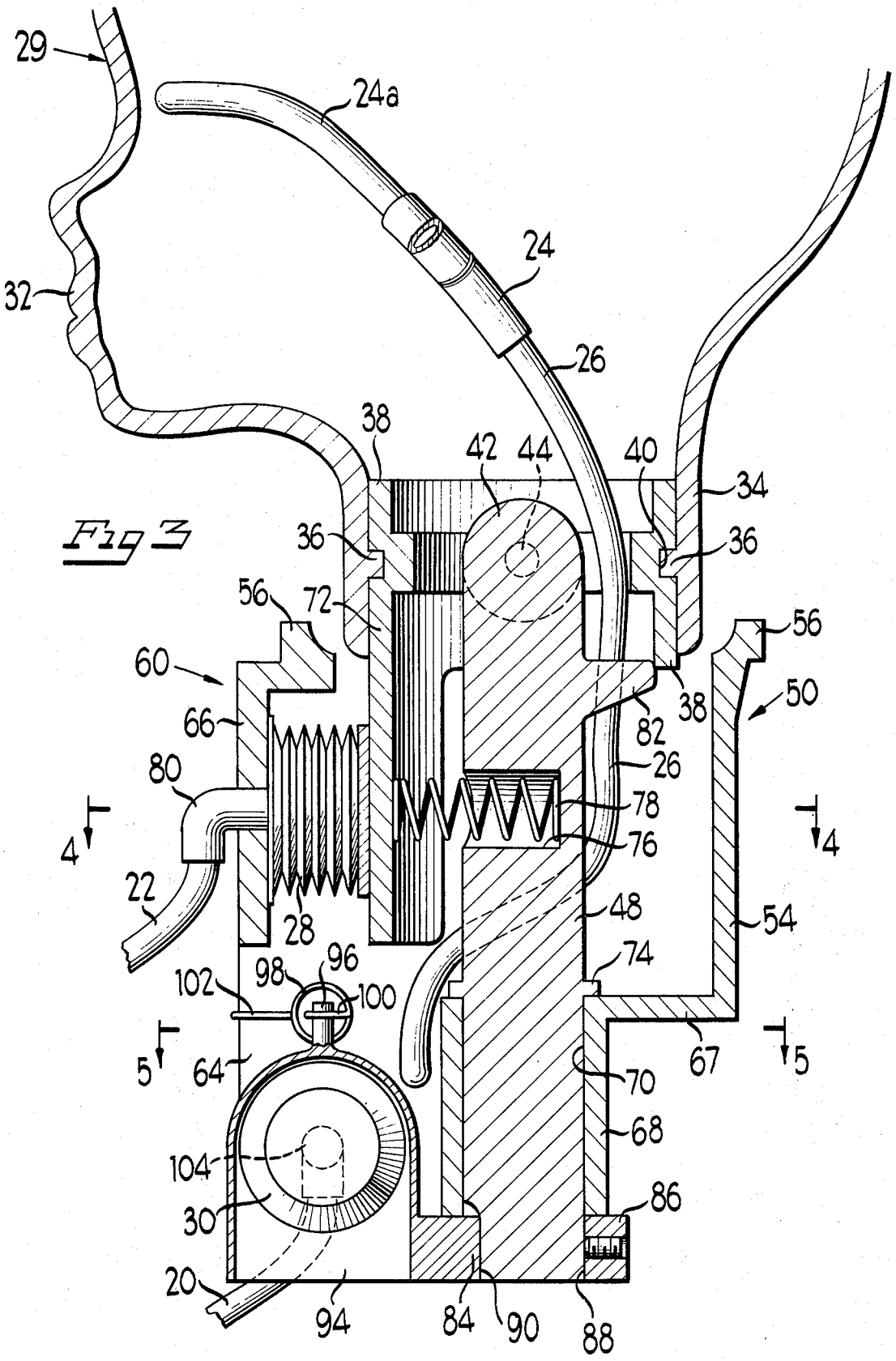
FIG. 3 is a section taken generally along line 3—3 of FIG. 2.

For head movement, air pressure is generated by squeezing the flexible bulbs 14 and 16 to cause the expansion, respectively, of a pair of bellows 28 and 30 (FIGS. 2–4). The expansion of the bellows, acting through connecting arms and levers (described hereinafter), cause the doll's head, generally designated 29, to move in the respective directions. The tears are caused by the bulb 18 which is connected by a conduit 31 (FIG. 1) to a water reservoir 30 located within the pocket 19 of the blanket 12. The water reservoir 30 is coupled by the flexible tube 26 which is connected to a Y-juncture 24 which splits the water to the left and right eyes of the doll by means of tubes **24*a*, causing tears to emerge from tear ducts therein when the bulb 18 is squeezed. The water reservoir is shown in FIG. 8 and includes a plug 30*a* at the top for filling purposes, and a one-way flap type check valve 30*b* at the entrance to tube 26**.

Referring to FIGS. 2, 3 and 7, the head 29 is formed by a generally hollow shell 32 with features of a human baby. The lower portion of the shell 32 narrows to form a neck portion 34. The neck portion 34 is of a generally cylindrical shape with an inwardly directed ridge 36 of rectangular cross-section. A generally cylindrical head support 38 has an external peripheral groove 40 of generally rectangular cross-section of complementary mating dimensions to the ridge 36 with the ridge 36 disposed therein.

A horizontal shaft 42 has a pair of concentric pivot pins 44 extending axially from the ends thereof. The shaft 42 is held horizontally within the head support 38 by the pair of pins 44 passing through appropriate apertures 46 (FIG. 7) within the head support 38. A vertical shaft 48 is formed integral with the shaft 42 and depends at right angles thereto passing through the head support 38.

Reciprocating head movement in a bobbing fashion in a vertical plane designating "yes", and reciprocating head movement in a horizontal plane designating "no" centers about the shafts 42 and 48. The reciprocating movement of the head 29 in the vertical plane designating an answer of "yes" is accomplished by the pivoting of the head support 38 about the pivot pins 44 on the ends of the horizontal shaft 42, the vertical shaft 48 being held steady. The reciprocating movement of the head 29 in the horizontal plane designating an answer of "no" is accomplished by rotating the vertical shaft about its longitudinal vertical axis.

An external neck collar, generally designated 50, is located in the upper part of the doll's body, generally designated 52 (FIG. 1), below the head 29 and forms a frame for the operative arms, levers, bellows, etc. for moving the doll's head. The collar 50 is shown in perspective in FIG. 7 and includes a generally hollow semi-cylindrically shaped portion 54, and an external peripheral ring portion 56 above the semi-cylindrical portion 54. The ring portions facilitate securing the doll's body 52 about the collar or frame 50. A three-sided generally rectangular portion 60 extends outwardly of the ring portion 56 opposite the semi-cylindrical portion 54 and has an upper wall 62 and two adjacent side walls 64 and 66. The lower end of the semi-circular cylindrical portion 54 has a semi-circular end wall 67 formed unitarily therewith. A generally hollow cylinder 68 depends concentrically from the end wall 67 and has a central hole 70 extending through the end wall 67.

Referring to FIG. 7, the vertical shaft 48 extends through the hole 70 and the cylinder 68. The cylinder 68 maintains the shaft 48 in a generally vertical orientation, providing vertical stability for the shaft 48 during its "no" rotating movement.

The head support 38 has a depending partially cylindrical tab 72 (see FIG. 7). The shaft 48 has an external circular flange 74 which seats about the hole 70 in the collar 50. The shaft 48 has a circular recess 76 (FIGS. 3 and 4) in the front thereof facing the tab 72. A coiled spring 78 has one end disposed within the aperture 76, the other end bearing against the inside of the tab 72 (FIG. 3). The bellows 28 is a sealed self-contained unit sandwiched between the inside of the wall 66 and the cylindrical tab 72. A tube connector 80 extends from the bellows 28 through an appropriate aperture in the wall 66 terminating a 90° downward bend for connection with the tube 22. A post 82 extends rearwardly from the shaft 48 abutting against the inside of the head support 38. The bellows 28 is biased in a compressed state by the spring 78 pushing against the tab 72.

In order to effect a "yes" motion for the doll's head 29, the squeegee bulb 16 is compressed, the air so displaced travels through the tube 22 and enters the bellows 28. The air entering the bellows 28 expands the bellows 28 in a horizontal longitudinal manner, pushing against the tab 72 and compressing the spring 78. The movement of the tab 72 acts as a lever to pivot the head support 38 and the neck 34 about the pivot pins 44. When so pivoted, the neck 34 moves downward and forwardly, and in turn, the head 29 moves downwardly and forwardly. The rear portion of the neck 34 and the head support 38 moves outwardly and upwardly, stopping when engaging the inside surface of a rearward portion of the ring 56 thus limiting the vertical downward movement of the head 29. Upon release of the bulb 16, the spring 78 expands compressing the bellows 28, pushing the tab 72 back to its original generally vertical orientation, thereby returning the head 29 to its original position. The return travel of the head 29 is limited by the abutment of the rear portion of the head support 38 with the stop post 82.

The rotational horizontal movement of the head or "no" function will now be discussed. Referring to FIGS. 3, 5, and 7, the lowermost portion of the shaft 48 has a flatted portion or key 84. The shaft 48 extends through the member 68 with the flatted portion 84 extending downwardly therethrough.

A ring 86 has a concentric aperture 88 therein with a flatted portion 90 formed from the wall of the ring 86 to form a mating keyway for the flatted portion 84 inserted therein. An arm 92 extends tangentially outwardly from the ring 86 perpendicular to the flatted portion 90. A flange 94 is formed from the arm 92, extending upwardly, perpendicular to the plane of the ring 86. The flange 94 is of a generally semi-circular shape with a pin 96 centrally located thereatop extending upwardly therefrom.

The bellows 30 is a sealed self-contained unit sandwiched between the flange 94 and the inside surface of the walls 64. A coiled spring 98 has an axial hook 100 on one end and a radial hook 102 on the other end. The hook 100 is hooked about the vertical pin 96, the radial hook 102 is hooked around the side of the wall 64. The bellows 30 has an integral spout 104 (FIG. 5) extending outwardly through an appropriate aperture in the wall 64 communicating with the inside cavity of the bellows 30. The spout 104 has a right angle and is attached to the air tube 20.

When the squeeze bulb 14 is compressed, the air so displaced is communicated through the tube 20 and the spout 104 to the bellows 30, wherein the bellows 30 expands against the biasing spring 98. The biasing spring 98 biases the bellows 30 in a normally compressed mode. When the bellows 30 expands against the bias of the spring 98, the expansion force pushes against the flange 94 which acting through the arm 92 turns the shaft 48 keyed into the ring 86. The rotation of the shaft 48 is communicated to the head support 38 by the pins 44. The rotation of the head support 38 causes the head 29 to also rotate. When the air pressure in the bellows is relieved the return spring 98 will rotate the shaft 48, the head support 38, and the head 29 back to the prior position.

The tears of the pair of eyes 106 are provided by a liquid solution placed within the reservoir 28 and conducted by the tube 26. The tube 26 enters the doll's body and travels upwardly through the head support 38 to their respective eyes 106, as described above. Referring to FIGS. 2 and 6, the tubes **24*a* terminate at small tear duct apertures 108 at the inside corner periphery of the eyes 106 above a nose 110**.

The tear ducts 108 are small tubes through the head wall 32. The water conduit tubes **24*a* terminate in close proximity to the eyes 106 within the head wall 32. The water conduit tubes 24*a* are of greater diameter than the duct tubes 108. The duct tubes 108 extend from the outside of wall 32 through the wall 32 into the water conduit tubes 24*a*** and for a distance thereinto.

The foregoing detailed description has been given for clearness of understanding only and no unnecessary limitations should be understood therefrom as some modifications will be obvious to those skilled in the art.

I claim:

1. An articulated doll, comprising:

a doll torso;

a doll head mounted on the top of said torso by connection means for movement of the head about a definite side-to-side horizontal axis in a bobbing motion to indicate an affirmative characteristic and for movement in a swiveling action about a generally vertical axis to indicate a negative characteristic;

a blanket for said doll for covering at least a portion of the doll; and actuating means disposed within a compartment of said blanket remote from said connection means but operatively associated therewith, through said blanket, for effecting movement of said head relative to said torso about either of said axes to indicate either affirmative or negative characteristics, with said blanket concealing said actuating means, wherein said doll head has apertures generally in the eye areas thereof, conduit means communicating between said apertures and said compartment of said blanket, and a liquid reservoir in said compartment connected with said conduit means, said actuating means further including means for moving liquid from said reservoir for excreting liquid from said apertures to simulate tearing by said doll.

2. The articulated doll of claim 1 including bellows means operatively associated with said connection means for pivoting said head about said horizontal axis, and including an air bulb within said blanket in communication with said bellows means for effecting movement of said head about said horizontal axis.

3. The articulated doll of claim 2 including biasing means operatively associated with said bellows means for returning said head to an upright position relative to said torso.

4. The articulated doll of claim 1 including bellows means operatively associated with said connection means for pivoting said head about said vertical axis, and including an air bulb within said blanket in communication with said bellows means for effecting movement of said head about said vertical axis.

5. The articulated doll of claim 4 including biasing means operatively associated with said bellows means for returning said head to an upright position relative to said torso.

* * * * *